US007631596B2

(12) United States Patent
Williams et al.

(10) Patent No.: US 7,631,596 B2
(45) Date of Patent: Dec. 15, 2009

(54) SCREW DEVICE

(75) Inventors: Maurice A. Williams, Brook Park, OH (US); Robert J. Williams, Painesville, OH (US)

(73) Assignee: Anderson International Corp, Cleveland, OH (US)

( * ) Notice: Subject to any disclaimer, the term of this patent is extended or adjusted under 35 U.S.C. 154(b) by 0 days.

(21) Appl. No.: 11/579,756

(22) PCT Filed: May 9, 2005

(86) PCT No.: PCT/US2005/016060

§ 371 (c)(1),
(2), (4) Date: Nov. 3, 2006

(87) PCT Pub. No.: WO2005/110038

PCT Pub. Date: Nov. 24, 2005

(65) Prior Publication Data

US 2007/0214971 A1 Sep. 20, 2007

Related U.S. Application Data

(60) Provisional application No. 60/569,426, filed on May 7, 2004.

(51) Int. Cl.
*B30B 9/18* (2006.01)
*B30B 9/14* (2006.01)

(52) U.S. Cl. ..... 100/149; 100/117; 100/147; 100/148

(58) Field of Classification Search ..... 100/117, 100/145, 146, 147, 148, 149, 150, 337, 338; 210/248, 402, 413, 414, 415
See application file for complete search history.

(56) References Cited

U.S. PATENT DOCUMENTS 3,035,511 A * 5/1962 Hayes ..... 100/117
3,225,711 A * 12/1965 Forth et. al. ..... 425/466
3,921,512 A * 11/1975 Burns ..... 100/117
4,915,830 A * 4/1990 Mackay et al. ..... 210/209
5,622,732 A * 4/1997 Beckwith ..... 425/466

* cited by examiner

*Primary Examiner*—Jimmy T Nguyen
(74) *Attorney, Agent, or Firm*—Calfee, Halter & Griswold LLP

(57) ABSTRACT

A choke for a screw device include a choking plug comprising a plurality of choking plug segments, and a choking ring cooperating with the choking plug, the choking ring comprising a plurality of choking ring segments. The plug segments may be releasably mounted to a hub is releasably mounted to a shaft of the screw device, and the choking ring segments releasably mounted to the barrel.

20 Claims, 8 Drawing Sheets

SCREW DEVICE

RELATED APPLICATIONS

This application claims the benefit of U.S. provisional patent application Ser. No. 60/569,426 for PRESS filed May 7, 2004, the entire disclosure of which is fully incorporated herein by reference.

BACKGROUND OF THE INVENTION

Screw devices such as screw presses, extruders, and expanders are used in processing oilseeds and other materials. Such a device has a rotating screw or worm assembly to move material down a barrel while compacting the material. A choke at the downstream end of the barrel helps to control the pressure on the material. The choke needs to be periodically adjusted, cleaned, and/or replaced. In some devices such as screw presses, the choke can only be accessed or removed by disassembling a large portion of the device including barrel portions and possibly removal of the worm assembly.

SUMMARY OF THE INVENTION

In one aspect of the invention, a choke for a screw device includes a choking plug comprising a plurality of choking plug segments, and a choking ring cooperating with the choking plug, the choking ring comprising a plurality of choking ring segments. In one embodiment, four plug segments are releasably mounted to a hub and four ring segments are releasably mounted to the barrel.

In accordance with another aspect of the invention, a method of operating the screw device is provided which relates to sensing a material parameter of the material and controlling the speed of a variable speed drive for the worm assembly in response to the sensed parameter. In one embodiment of the present invention, the material temperature within the screw device is sensed and the rotational speed of the worm assembly is controlled in response to the material temperature. In another embodiment of the present invention, the amount of pressure exerted on the material within the screw device is sensed or judged and the rotational speed of the worm assembly is controlled in response to the material temperature In accordance with another aspect of the invention, a method of operating the screw device is provided which relates to controlling material temperature by injecting water into the material. In one embodiment of the present invention, the temperature of the material is sensed in the discharge portion of the screw device, and in response to the sensed temperature, water is injected into the discharge portion of the screw device.

DETAILED DESCRIPTION

Figure 1:
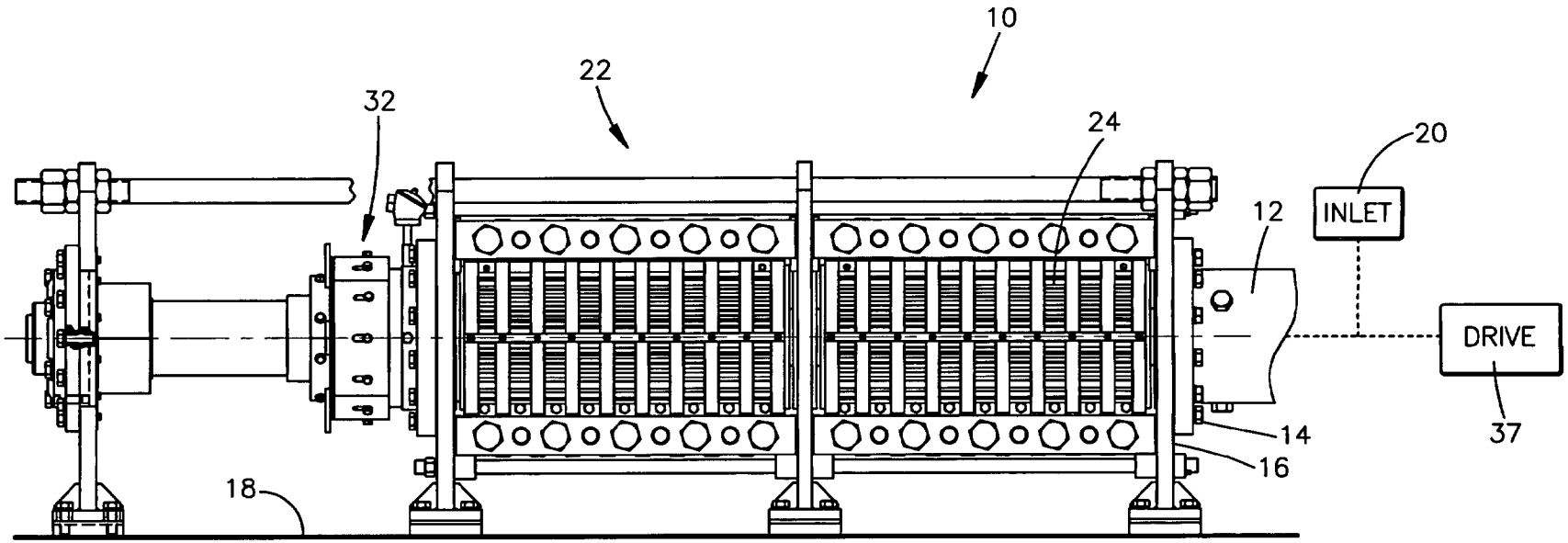
FIG. 1 is a longitudinal side view of a screw device in the form of a screw press that is a first embodiment of the invention.

FIG. 1 shows a screw device 10 in accordance with a first embodiment of the present invention. The screw device 10 is a screw press, although the invention is applicable to other screw devices, such as expanders and extruders. The screw device 10 includes a barrel assembly or barrel 12 formed as an elongate, generally cylindrical tube. The barrel assembly 12 is formed from multiple barrel segments 14 (FIG. 2) supported in-line by frames 16 anchored to a base or floor 18. The barrel assembly 12 includes an entry or inlet portion 20 (shown schematically in FIG. 1) at an upstream location (located to the right in FIGS. 1-4) on the screw device 10.

The barrel 12 also includes a drainage portion 22 (FIG. 1) to allow oil that is librated from the material by compacting to flow out of the barrel wall 24. The drainage portion 22 may be configured in a manner well known in the art. For example, prior screw device designs have employed an assembly of individual barrel bars divided by spacers and held together in a supporting assembly. The spacers provide openings between the barrel bars for oil to escape.

Figure 2:
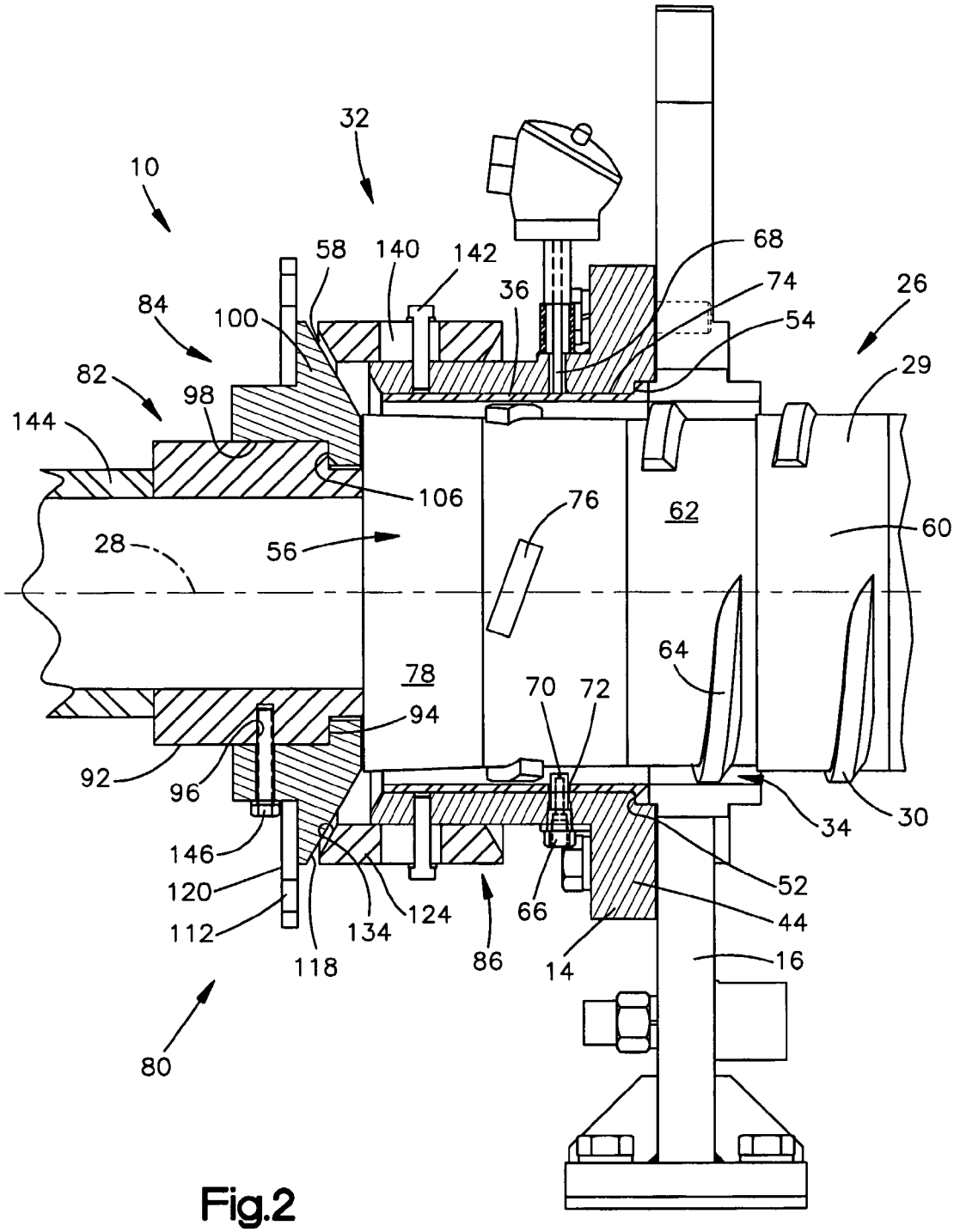
FIG. 2 is a sectional view of a discharge portion of the screw press of FIG. 1.
Figure 3:
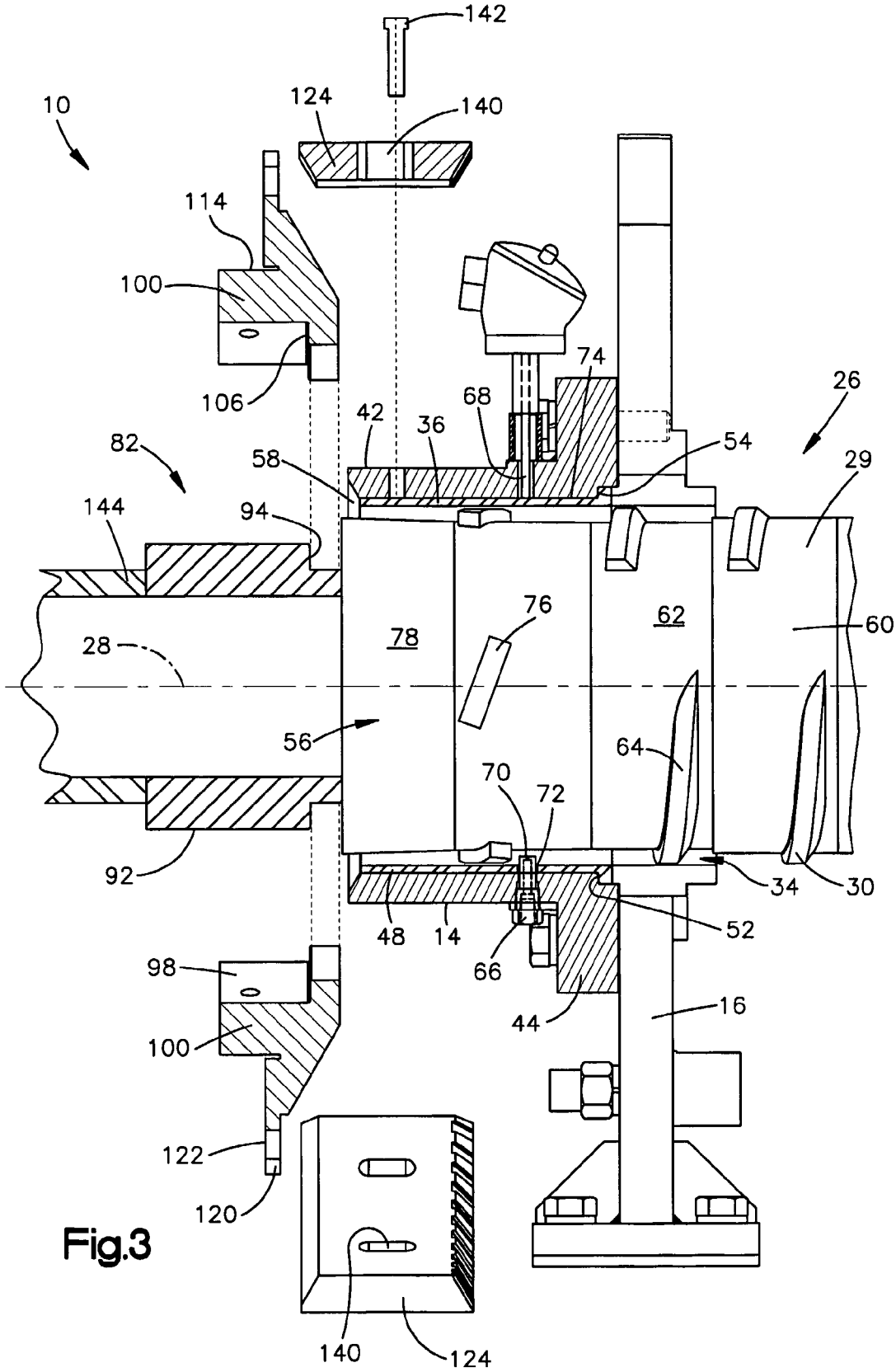
FIG. 3 is an exploded sectional view of a discharge portion of the screw device of FIG. 1.
Figure 5:
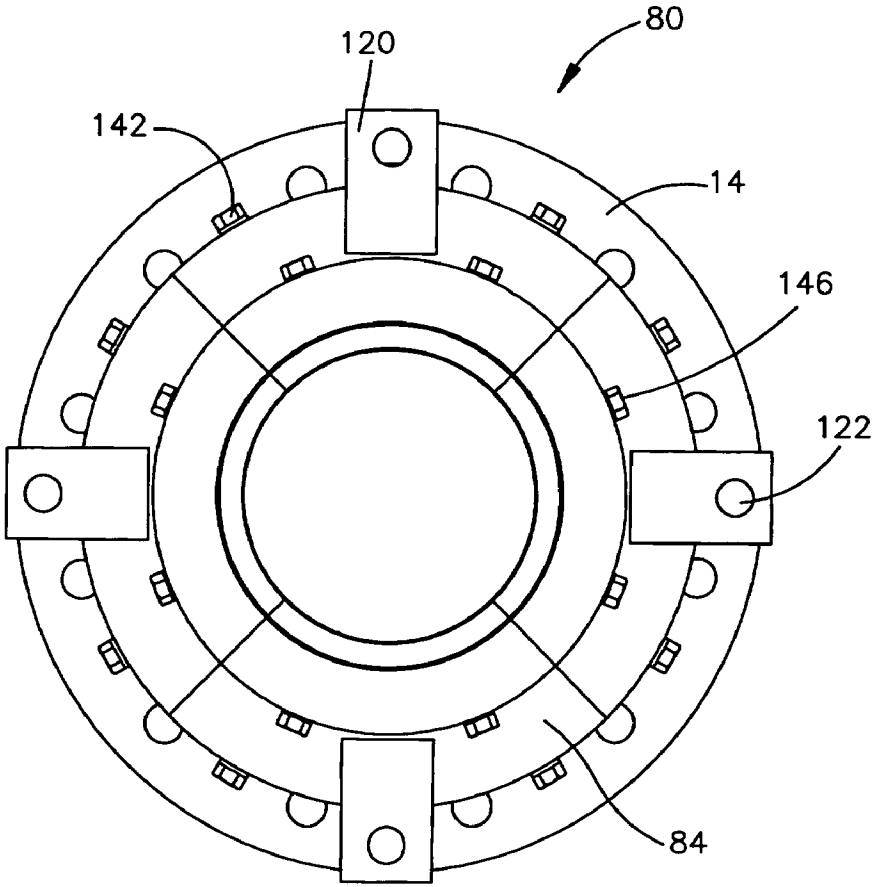
FIG. 5 is a rear elevational view of the choke assembly on the barrel.
Figure 4:
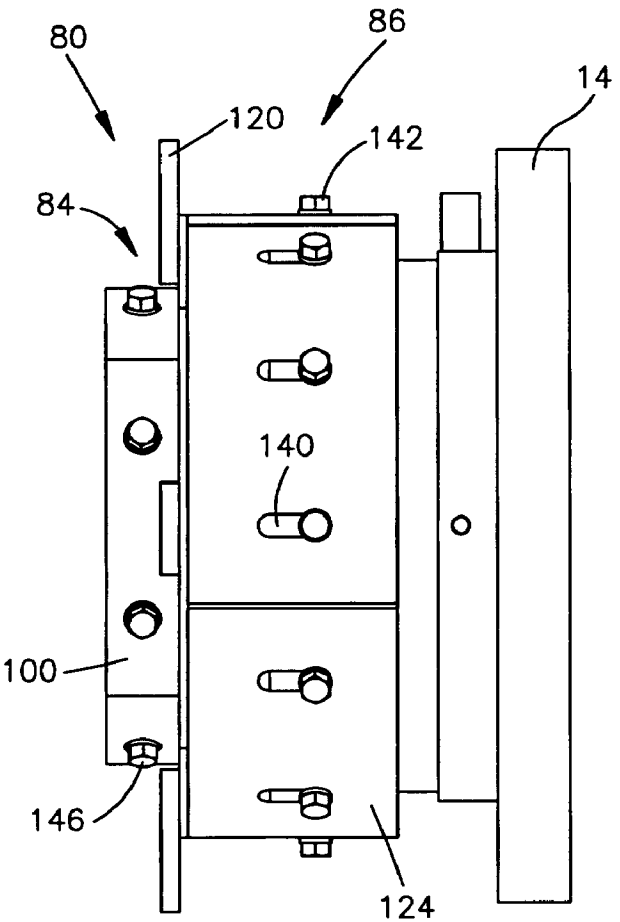
FIG. 4 is a side elevational view of a choke assembly installed on a barrel of the screw device of FIG. 1.

Within the barrel assembly 12 is a screw or worm assembly 26 rotatable about a central longitudinal axis 28 (see FIGS. 2-3). The worm assembly 26 includes a shaft 29 and a plurality of screw or worm elements 30 mounted on the shaft for rotation therewith. The worm elements 30 are positioned along the length of the shaft 29 from the inlet portion 20 (shown schematically in FIG. 1) to a discharge portion 32 located at a downstream (to the left as viewed in FIGS. 1-4) location on the screw device 10. An axial annular channel 34 is defined between the shaft 29 and the inner side surface of a sleeve 36, as well as within the flights of the worm elements 30, for material to move along.

A drive mechanism 37 (shown schematically in FIG. 1), for example a motor with a variable speed drive, rotates the shaft 29. The inlet portion 20 allows product or material to be placed within the barrel 12 of the screw device 10. As the shaft 29 rotates, the worm assembly 26 moves the material in a downstream direction in the barrel 12. As the material is moved downstream, the worm assembly 26 removes oil from the material by compacting it. The removed oil drains out through the drainage portion 22 of the barrel 12.

Figure 8:
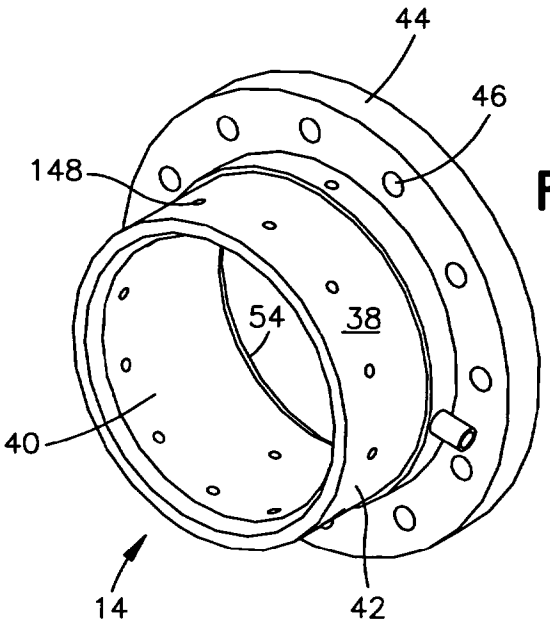
FIG. 8 is a perspective view of a barrel segment of the discharge portion of the screw device of FIG. 1.
Figure 6:
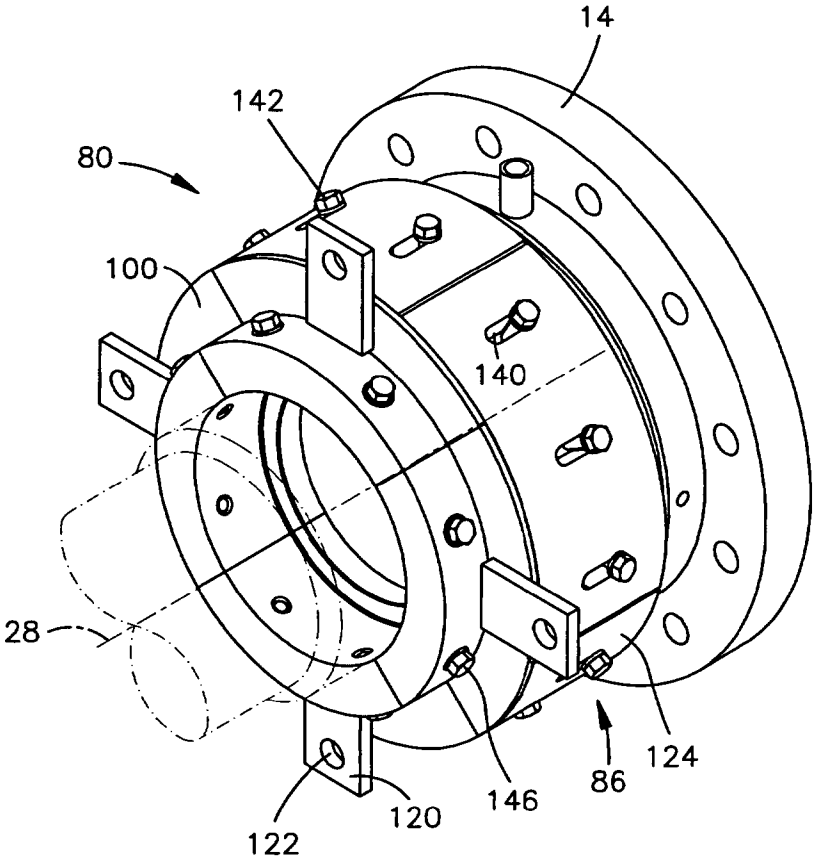
FIG. 6 is a perspective view of the choke assembly on the barrel.

FIG. 2 illustrates a cross section of the discharge portion 32 of the screw device 10. The barrel segment 14 (FIG. 8) includes a sidewall 38 having a generally cylindrical configuration centered on the central axis 28. The sidewall 38 has parallel, cylindrical inner and outer side surfaces 40, 42. The barrel segment 14 includes a radially extending flange 44. The flange 44 includes a series of bolt holes 46 for attaching the barrel segment 14 to the frame 16.

Figure 7:
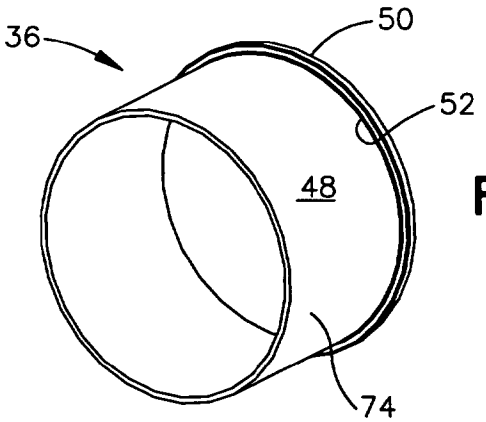
FIG. 7 is a perspective view of a sleeve that forms part of the discharge portion of the screw device of FIG. 1.

The barrel assembly 12 also includes a sleeve 36 (FIG. 7). The sleeve 36 includes a sidewall 48 having a generally cylindrical configuration centered along the central axis 28. The outer diameter of the sleeve 36 is designed to be slightly smaller than the inner diameter the barrel segment 14 such that the sleeve can be positioned tightly within the barrel segment (see FIG. 2). The sleeve 36 includes a radially extending flange 50 defining a rearward facing shoulder 52 engaging a mating forward facing shoulder 54 of the barrel segment 14 to fix the sleeve in axial position relative to the barrel segment.

The discharge portion 32 of the screw device 10 includes a discharge collar 56 of the worm assembly 26 and an exit opening or choke passage 58 (FIGS. 2-3). The discharge collar 56 is positioned on the worm assembly 26 for rotation therewith and is generally located between the exit opening 58 and the last worm segment 60 in which compacting and release of oil from the material occurs. The discharge collar on a prior design worm assembly typically has a smooth outer surface. In the embodiment in FIG. 2 of the present invention, the discharge portion 32 is modified to optimize the use of water injection to influence material temperature (discussed in detail below).

The discharge portion 32 of the present invention includes a reduced diameter shaft section 62 with an agitator worm element 64. The agitator worm element 64 is designed to create rotation of the compacted material to minimize the amount of material riding on the shaft 29. The agitator worm element 64 can be configured in a variety of ways known in the art. The reduced outer diameter of the section 62 creates a deeper channel 34 in the discharge portion 32 of the screw press 10, which effects a reduction in pressure on the material.

Downstream from the agitator worm element 64, a water injector 66 and a temperature sensing device 68 are positioned radially outward from the worm assembly 26. The water injector 66 is mounted onto the barrel segment 14 with an injector nozzle 70 being received within an injection hole 72 in the barrel segment. The nozzle 70 is positioned to inject water directly into the compacted material in the deep portion of the channel 34.

The temperature sensor 68, such as for example a thermocouple, is located against an exterior surface 74 of the sleeve 36. The temperature on the exterior surface 74 is an accurate representation of material temperature. Other temperature sensing devices, such as a thermometer, resistance temperature detector (RTD), or thermistor, for example, can be used instead of a thermocouple.

Downstream from the water injector 66, still in the discharge portion 56, the worm assembly 26 includes a shaft section with stirring lugs 76. The stirring lugs 76 take the form of short, discontinuous portions of a spiral worm element. The stirring lugs 76 help mix the injected water with the material. Downstream from the stirring lugs 76, the discharge collar 56 includes a tapered section 78. The tapered section 78 tapers radially outward toward the exit opening 58. As a result of the tapered section 78, the channel 34 narrows in a downstream direction, that is, as the material approaches exit opening 58. The narrow portion of the channel 34 in the tapered section 78 compresses the material to facilitate movement of the material toward the exit opening 58.

The exit opening 58 is configured as a generally annular slot defined by a choke 80. The choke 80 restricts the flow of the material exiting the press 10 in order to create pressure within the press for compacting the material.

The choke 80 consists of three main units: a hub 82, a choking plug 84, and a choking ring 86. The hub 82 has a generally cylindrical configuration with a central through bore 88 for receiving the shaft 29 (FIGS. 9B-C). The hub 82 has a smaller diameter forward portion 90, a larger diameter rearward portion 92, and a radially extending shoulder 94. The hub 82 also includes a plurality of circumferentially spaced bolt holes 96 on the rearward portion 92 for attaching the choking plug 84 to the hub.

Figure 9A:
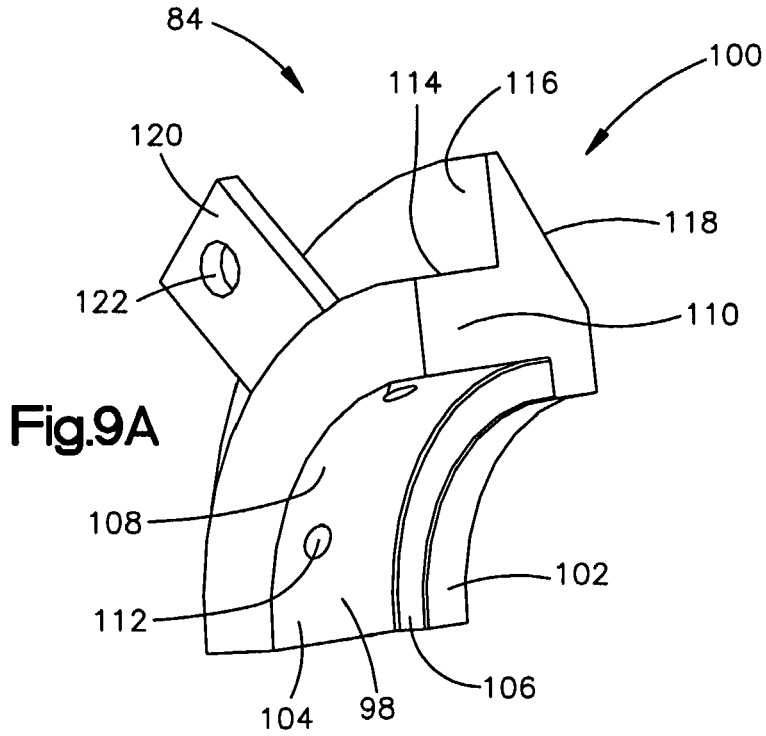
FIGS. 9A-E are perspective views of components of the choke assembly of the screw device of FIG. 1.
Figure 9B:
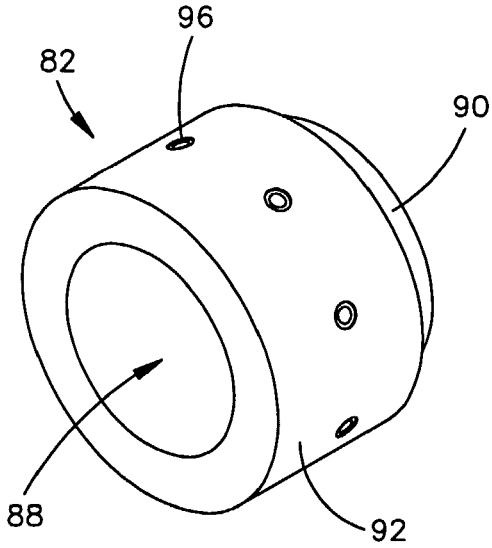
Figure 9C:
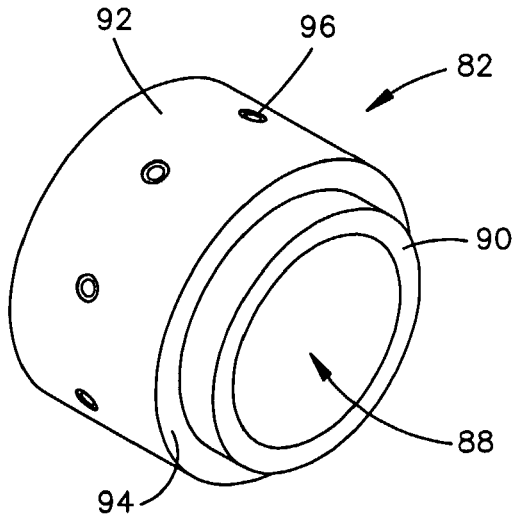
Figure 9D:
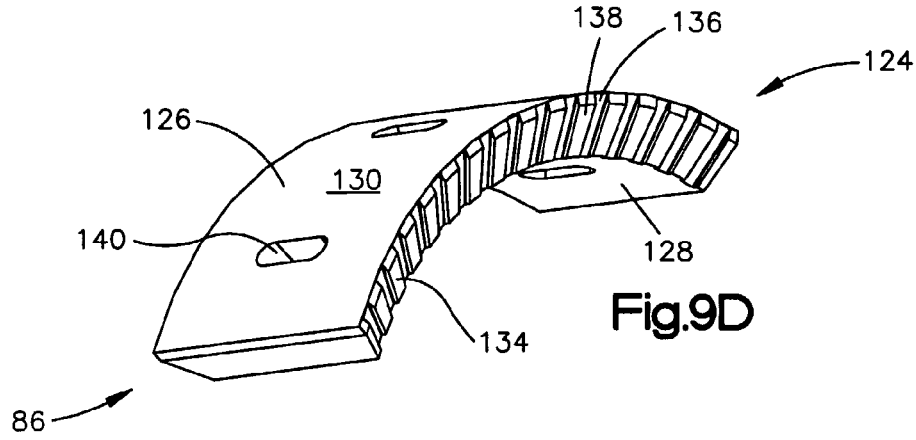
Figure 9E:
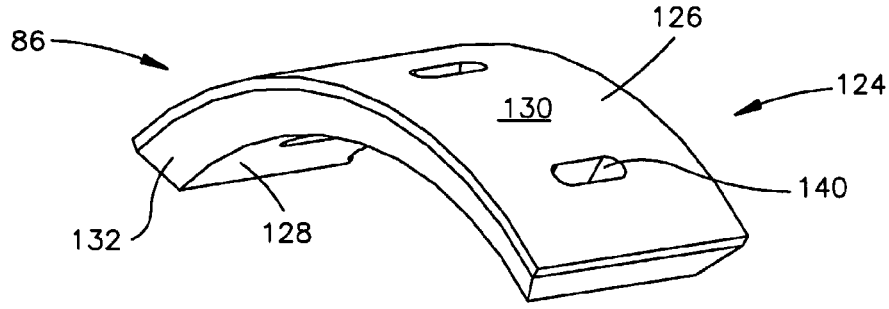

The choking plug 84 is an annular structure with a generally cylindrical interior wall 98 for engaging the hub 82 (FIGS. 2, 9A). The choking plug 84 is formed from multiple choking plug segments 100. For example, the choking plug 84 may consist of four plug segments, each extending about 90 degrees about the circumference of the hub 82. However, any suitable number of plug segments, two or greater, may be used to form the choking plug.

The interior wall 98 of the plug segment 100 includes a forward portion 102 and a rearward portion 104 connected by a rearward facing shoulder 106. The rearward portion 104 forms an inner surface 108 of a rearward extending flange 110. The flange 110 includes a series of bolt holes 112 for attaching each plug segment 100 to the hub 82.

The flange 110 includes an outer surface 114 which transitions into a rearward facing radially extending surface 116. The rearward facing radially extending surface 116 connects the flange 110 to a tapered surface or face 118. The tapered face 118 extends axially rearward and radially outward away from the central longitudinal axis 28. The tapered face 118 contacts the compacted material during operation of the press 10.

Each plug segment 100 also includes a cake cutter 120. The cake cutter 120 extends radially outward from the flange surface 114 adjacent to the rearward facing radially extending surface 116. Each cake cutter 120 includes a lifting hole 122 to assist in removing and replacing the plug segments 100.

The choking ring 86 is formed from multiple ring segments 124. For example, the choking ring 86 may consist of four ring segments, each extending about 90 degrees about the circumference of the barrel 12. However, any number of ring segments, two or greater, may be used to form the choking ring 86. The choking ring 86 includes a sidewall 126 having a generally cylindrical configuration (FIGS. 2, 9A-E). The sidewall 126 has parallel, cylindrical inner and outer side surfaces 128, 130.

Each ring segment 124 has tapered forward and rearward edges, 132, 134. The ring segments 124 may be generally symmetrical; thus, each segment can be reversed so that the rearward tapered edge 134 becomes the forward tapered edge 132 and vice versa. The ring segments 124 may include alternating axial grooves 136 and ridges 138 along one or both of the tapered edges 132, 134 for restricting rotation of the material.

Each choking ring segment 124 also includes a series of circumferentially spaced slots 140. Each slot 140 can accept a securing bolt 142 for allowing the segment 124 to attach to a barrel segment 14 (FIG. 2). The slots 140 further allow the ring segments 124 to be selectively positioned along the barrel segment 14 at a plurality of different axial positions relative to the choking plug 84.

When the choke 80 is assembled (FIG. 2 and FIGS. 4-6), the hub 82 mounts onto the shaft 29 by receiving the shaft through the through bore 88. The shaft 29 includes various shaft segments 144. For example, some portions of the shaft 29 may have a larger diameter or contain different worm elements than another portion. The hub 82 when mounted onto the shaft 29, is sandwiched tightly between two of the shaft segments 144. When mounted on the shaft 29 in this manner, the hub 82 forms a rigid base for mounting the choking plug 84 that is thus fixed axially relative to the shaft and rotates with the shaft.

Each choking plug segment 100 is attached to the hub 82 via bolts 146, allowing the plug 84 to rotate with the hub. Specifically, the plug segments 100 are positioned on the hub 82 such that the hub shoulder 94 engages the plug shoulder 106. To secure the plug segments 100 in place, the bolt holes 112 in the flange 110 of each plug segment receive a securing bolt 146 which threads into the bolt holes 96 on the rearward portion 92 of the hub 82. With the plug and hub shoulders 106, 94 engaged, all forward thrust by the material onto the plug 84 is transmitted to the hub 82 through the shoulder 94. Thus, the securing bolts 146 are not subjected to shearing forces caused by the forward thrust.

The choking ring 86 mounts onto the outer side surface 42 of the barrel segment 14. Each slot 140 on the choking ring segments 124 receive a securing bolt 142 which threads into a bolt hole 148 located on the outer side surface 42 of the barrel segment 14. The securing bolts 142 are tightened down to lock the choke ring segments 124 in position axially relative to the choking plug 84. When the bolts 142 are loosened, the slots 140 allow for axial adjustment of the choking ring 86 relative to the choking plug 84. The choking ring 86, however, can be provided with alternative means for adjusting its position relative to the choking plug 84, as discussed below.

The rearward edge 134 of the choking ring 86 and the tapered surface 118 of the choking plug 84 are installed adjacent to each other to form the choke passage or exit opening 58. Thus, because the choking ring 86 can be selectively positioned relative to the choking plug 84 the size of the exit opening 58 can be adjusted in order to increase or decrease the amount of choking (pressure exerted on the material).

Since the choking ring 86 attaches to the barrel 12, the ring does not rotate with the shaft 29. When the material being compacted reaches the choking ring 86, it has gone through the entire compacting process and is typically low in moisture and at an elevated temperature, for example about 300° F. As a result, if the material rotates with the shaft 29 when in contact with the choking ring 86, considerable heat is generated from the resulting friction.

As material is forced past the choking ring 86, the material will fill and flow along the grooves 136. Rotation of the material in the grooves 136 is impeded by the ridges 138. Thus, the alternating grooves 136 and ridges 138 cooperate to prevent the material from rotating, which reduces heat build up from friction. An additional benefit of preventing rotation of the compacted material is that it adds more forward thrust to the material in order to force it out of the device 10 more quickly.

The choking plug 84 and the choking ring 86, because they are in direct contact with highly compacted material, tend to wear during operation of the screw device 10. Therefore, it is advantageous for these parts to be easily replaceable. To replace the plug 84 and ring 86 in prior screw press designs, other parts of the device must first be removed in order gain access to and remove the choke assembly parts. For example, it is common to have to remove the entire worm assembly in order to replace prior art choking plugs that are shaft-mounted. Further, additional structure, such as for example a portion of a housing or barrel or an actuator, is often positioned radially outward of the choking plug and choking ring. This additional structure must be removed in order to gain access to and remove/replace the choking plug or choke.

In the current invention screw device 10, however, the positioning and configuration of the choking plug segments 100 and the choking ring segments 124 allow the plug and ring to be removed/replaced without having to disassemble, remove, or disturb any other part of the screw device 10 (i.e. the barrel, the worm shaft, etc.) (FIG. 3). The choking ring segments 124 and plug segments 100 are unobstructed in a radially outward direction, away from the axis of rotation 28 of the worm assembly 26; thus, the parts are easily accessible and removable. No movement of any other part of the screw device 10, especially the shaft 29 as a whole, is needed.

Specifically, each choking ring segment 124, which resides on the outer side surface 42 of the barrel 12, can be removed by simply removing the bolts 142 from each choking ring segment and lifting the segment away from the barrel 12 in a radial direction. In a similar manner, the plug segments 100 can also be removed by removing bolts 146 that secure the plug segments to the hub 82. The plug segments 100, however, are heavier than the ring segments 124 and may require a lifting device. The plug segments 100, though engaging the hub 82 at the shoulder 106 and inner surface 98, fit loosely into place on the hub; thus, they can be removed easily. A lifting device, such as a chainfall, can utilize the lifting hole 122 on the cake cutting device 120 as an attachment point to remove and replace the plug segments 100. The hub 82 stays fixed to the shaft 29.

Figure 10:
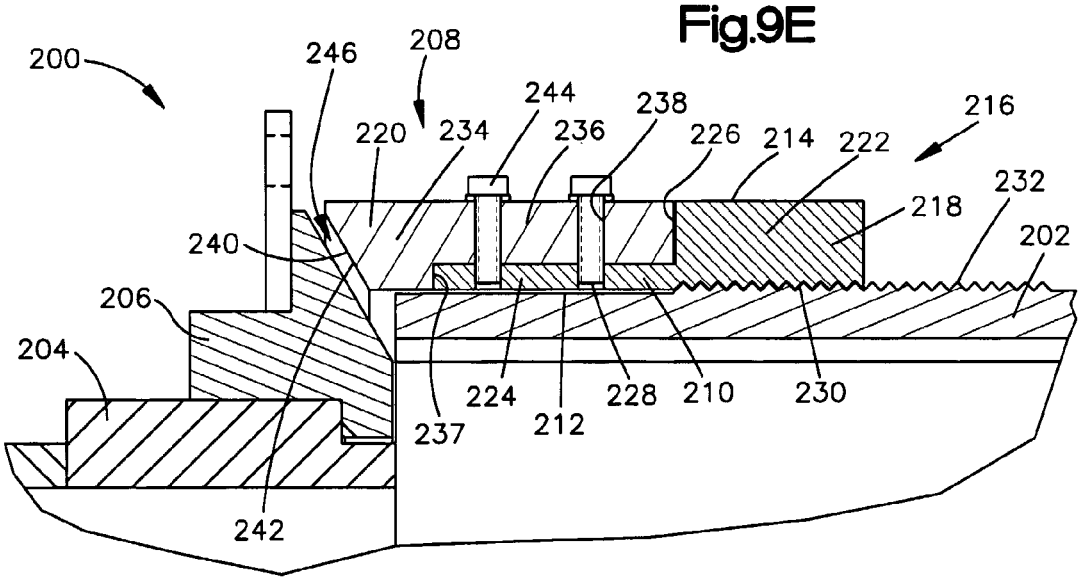
FIG. 10 is a sectional view of another embodiment of a choke assembly of the invention.

FIG. 10 illustrates another embodiment of the present invention. In this embodiment, the screw device 200 includes a barrel assembly 202, hub 204, and choking plug 206 that may be similar in design to the embodiment of FIGS. 2-9 described hereinabove. The choking ring 208 of the embodiment of FIG. 10 is also similar to the choking ring 80 in the embodiment of FIGS. 2-9 in that it includes a sidewall 210 having a generally cylindrical configuration with parallel, cylindrical inner and outer side surfaces 212, 214. The choking ring 208 is also formed from multiple ring segments 216. In this embodiment, however, each choking ring segment 216 include two, partially-overlapping pieces: a support member or housing portion 218 and an individual wear pad 220.

The housing portion 218 includes a forward portion 222 connected to a thinner rearward portion 224 by a rearward facing radial surface 226. The rearward portion 224 includes one or more bolt holes 228 to facilitate attaching the wear pad 220.

The inner side surface 212, primarily located on the housing 218, may include a female thread 230 to engage a mating male thread 232 on the barrel assembly 202. The housing 218 can thread onto the barrel 202 to adjustably attach to the barrel. Thus, the threaded engagement allows axial adjustment of the choking ring 208 by adjusting how far the ring is threaded onto the barrel 202.

The housing 218, however, can attach to the barrel 202 by other methods, such as fasteners, clamps, or the other means.

The wear pad 220 includes a rearward portion 234 connected to a thinner forward portion 236 by a forward facing radial surface 237. The forward portion 236 includes one or more bolt holes 238 to facilitate attaching to the housing 218. The rearward portion 234 includes a tapered face 240 along its rearward edge 242.

When installed, the forward portion 236 of the wear pad 220 engages the rearward portion 224 of the housing 218 radially outward from the housing rearward portion. Securing bolts 244 are used to attach the wear pad 220 to the housing 218. In a manner similar to that described in relation to the embodiment of FIG. 2-9, the tapered face 240 cooperates with the choking plug 206 to form an exit opening 246 and may include a series of ridges and grooves similar to the ridges 138 and the grooves 136.

Because the tapered face 240 of the wear pad 220 is the only part of the choking ring 208 that contacts material during operation, the wear pad is the only part of the choking ring that wears and needs replacing. The wear pad 220 is positioned so that it is unobstructed in a radially outward direction; thus, it is easily accessible and removable. The wear pad 220 can be removed simply by removing the bolts 244 fastening it to the housing 218.

The present invention also relates to operational methods for a screw device 10. One operational method of the present invention includes influencing material temperature by injecting water into the material before the material is discharged through the exit opening 58.

As described above, a water injector 66 is provided in the discharge portion 32 (FIG. 2). The area surrounding the discharge collar 56 is the area most apt to overheat because the oil level of the material is at its lowest and the hard packed material rides on the surface of the discharge collar. By injecting water at the point in which all the recoverable oil has been recovered (i.e. the material is no longer reducing in oil level), the moisture level of the material can be raised a few percentage points to soften and cool the material. This, in effect, lubricates the material resulting in reduced frictional buildup of heat.

In addition to reducing material temperature, water injection can be used to effectively control material temperature to an optimal level. During operation of the screw press 10, the temperature of the material should not be too high because of the aforementioned tendency to degrade. Elevated temperatures, however, are important to the efficiency of the screw device 10. Elevated temperatures soften the material permitting the screw device 10 to run at higher capacity for a given sized motor. Thus, it is advantageous to control material temperature to an optimal range. The optimal temperature range can be determined by measuring material temperature and inspecting the characteristics of the discharged material.

Figure 11:
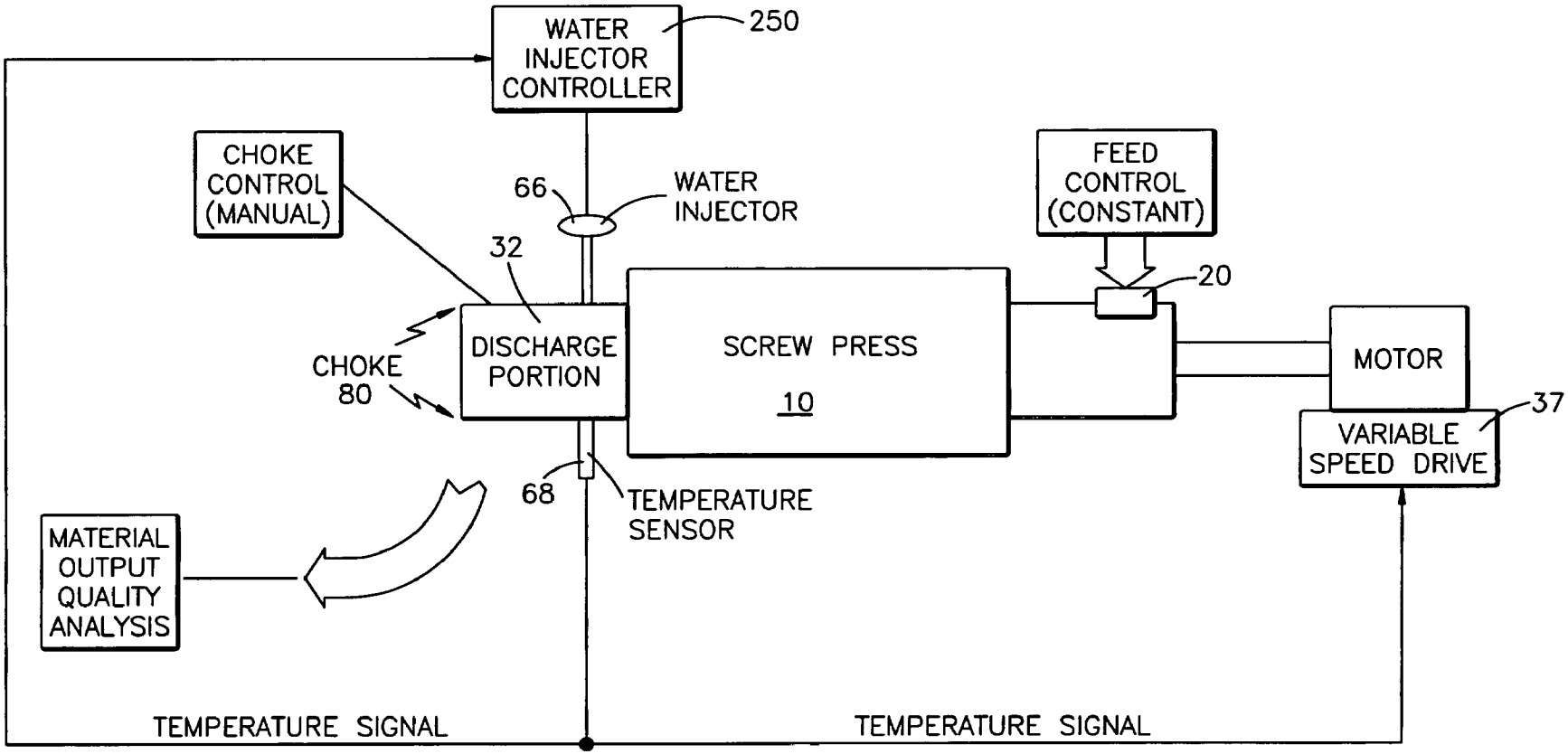
FIG. 11 is a schematic illustration of components and operation of a screw device of the present invention.

With reference to FIG. 11, to control material temperature, the temperature reading generated by the temperature sensor 68 (FIG. 2) can be used as a feedback parameter to control the amount of water being injected. Specifically, the temperature reading can be fed back to a water injector control unit 250 to indicate whether additional water or less water should be injected. The control unit 250 can then make the appropriate adjustment to the amount of or timing of the water injection. For example, if the temperature is above a predetermined optimal value, then more water can be injected into the material. Likewise, if the temperature is below the optimal value, less water can be injected. The specific details and devices used to effect closed-loop control, for example the use of controllers, signal converters, or other devices, are well known in the art and readily applicable to the present invention.

The design of the discharge collar 56, discussed hereinabove, improves the effectiveness of water injection. Specifically, the deeper channel depth positioned immediately prior to water injection reduces pressure on the material and provides additional space to stir the material. Stirring the material prior to (and during) water injection minimizes the amount of material riding on the rotating shaft 29. After water injection, the stirring lugs 76 on the worm assembly help mix the water with the material. Mixing the water into the material allows the cooling and lubricating effects of the water to be more evenly distributed throughout the material. The radially outward tapered section 78 of the discharge collar 56 narrows the channel 34 as the material approaches the choke 80 and exit opening 58. The narrower channel 34 compresses the material to facilitate movement of the material to the exit opening 58.

Other aspects of the invention relate to operational methods for influencing performance of the screw device 10 by varying the worm assembly rotational speed while keeping the material throughput of the screw device 10 constant. The methods relate to sensing a parameter of the material and using a variable speed drive to control the rotational speed of the worm assembly in response to the sensed parameter. The sensed parameter can include, for example, the material temperature within the screw device, the amount of pressure exerted on the material within the screw device, or a characteristic, such as appearance, of the discharged material. Further, the sensed parameter can include parameter indirectly related to the material, such as the load on the motor of the screw device, which can be influenced by a material parameter, such as the pressure exerted on the material.

One embodiment of an operational method for influencing performance of the screw device 10 relates to varying the worm assembly rotational speed in order to influence the amount of pressure (or choking) exerted onto the material. Another embodiment of an operational method for influencing performance of the screw device 10 relates to varying the worm assembly rotational speed in order to influence the temperature of the material.

Rotational speed of the worm assembly 26 can be varied by employing a motor in combination with a variable speed drive 37 to drive the screw device 10. The drive is referred to as variable speed because the rotational speed of the motor (and the rotational speed of the worm assembly) can be changed directly under the control of the user; such a drive is sometimes referred to as an adjustable speed drive. Prior design screw presses have not employed variable speed drives, instead using constant speed motors or employing replaceable drive gears that can modify the rotational speed of the worm assembly but require the screw device to be shut down in order to change the drive gears. Closed-loop control in not possible with such a system. For this reason, adjusting the amount of pressure exerted on the material or the temperature of the material is typically accomplished either by adjusting the choke 80 to increase or decrease the restriction at the exit opening 58, or by adjusting the feed rate of material into the device at the inlet 20.

Variable speed drive systems are configured for the unique demands and characteristics of a given application. For example, the type of variable speed drive used, and the type and size of the motor are considerations that are taken into account when configuring a system. For the screw device 10 of the present invention, the size of the screw device and the type of material being compacted must be taken into account when configuring the variable speed drive system. For example, generally, an appropriately sized alternating current (AC) induction motor with a compatible commercial variable speed drive will be suitable for use with the screw device 10. Other system configurations, however, can be equally suitable and used with the screw device 10.

In the exemplary system, the variable speed drive adjusts the speed of an AC induction motor by changing the frequency of the supply voltage to the motor. The higher the input frequency, the faster the motor runs. Most commercial variable speed drive units consist of three basic parts: a rectifier, an inverter, and a set of controls. The rectifier converts the fixed frequency AC input voltage to direct current (DC). The inverter switches the rectified DC voltage to an adjustable frequency AC output voltage (the inverter may also control output current flow, if desired). The rectifier and the inverter are connected by a DC link. The set of controls directs the rectifier and the inverter to produce the desired AC frequency and voltage to meet the needs of the variable speed system or the control strategy.

Varying worm assembly rotational speed, in accordance with the invention can effectively modify the amount of pressure on the material and the temperature of the material without having to adjust the choke or the material feed rate. The worm assembly 26 compacts the material by progressively reducing the volume between worm elements 30 as the material is moved downstream along the worm assembly. When the material feed rate and the choke assembly setting are held constant, the rotational speed of the worm assembly 26 dictates the amount of material the accumulates in the first revolving worm segment. A faster rotational speed allows less time for material to accumulate within the segment and a slower rotational speed allows more time. If the feed rate is constant (as is typical), a slower rotational speed results in more material within the worm segment; thus more material is compressed into the progressively reducing volume between the worm elements 30. As a result, the amount of pressure (choke) exerted onto the material increases. Conversely, if the rotational speed of the worm assembly 26 is increased, less material accumulates in the worm segment and less pressure is exerted onto the material during compaction.

Pressure exerted on the material can be monitored and controlled in a variety of ways. For example, a pressure sensor (not shown) can be provided to monitor the pressure on the material at a given location along the worm assembly 26. The pressure signal can be fed back to the variable speed drive 37 to indicate whether the rotational speed should be increased or decreased. The drive 37 would then make the appropriate adjustment to rotational speed of the motor.

As another example, instead of using a pressure sensor, the amount of pressure being exerted onto the material can be judged by monitoring the amount of load on the drive motor or the characteristics of the discharged material. The specific details and devices used to effect closed-loop control, for example the use of controllers, signal converters, or other devices, are well known in the art and readily applicable to the present invention.

Rotational speed of the worm assembly 26 also has an impact on the temperature of the material. If the material feed rate and the choke assembly setting are held constant, the rotational speed of the worm assembly 26 dictates the rate in which material flows through the screw device 10. Increasing rotational speed of the worm assembly 26 increases the rate of flow of the material. Increasing the rate of flow of the material increases the amount of heat caused by friction between the material and the worm assembly 26 and barrel 12 or sleeve 36. Therefore, increasing the rotational speed of the worm assembly 26 increases the temperature of the material. Conversely, decreasing the rotational speed decreases the temperature of the material.

Temperature of the material can be monitored in the same manner as described above for monitoring and controlling temperature for water injection. Further, rotational speed of the worm assembly 26 can be controlled using temperature as the feedback parameter in the same manner as discussed above for controlling the amount of pressure exerted on the material by varying the rotational speed of the worm assembly 26.

The operational methods disclosed above are described as being under closeloop control, for example proportional-integral-derivative (PID) closed-loop control. The methods, however, can also be used with open-loop control in which an operator monitors the feedback parameter and makes the necessary adjustments to the screw device 10 during operation. Further, the control system of FIG. 11 gives the operator the option of controlling by any one of the methods described or by more than one of the methods described. For multiple methods, a hierarchy for the control strategy can be established to determine which action should be taken first based on the feedback parameter.

While the present invention has been illustrated by the description of embodiments thereof, and while the embodiments have been described in considerable detail, it is not the intention of the applicants to restrict or in any way limit the scope of the appended claims to such detail. Additional advantages and modification will readily appear to those skilled in the art. Therefore, the invention, in its broader aspects, is not limited to the specific detail, the representative apparatus, and illustrative example shown an described. Accordingly, departures may be made from such details without departing from the spirit or scope of the applicant's general inventive concept.

The invention claimed is:

1. A choke for a screw device, the choke comprising:

a multi-piece choking plug comprising a plurality of choking plug segments, each of the choking plug segments corresponding to one of the choking plug pieces; and a multi-piece choking ring cooperating with the choking plug, the choking ring comprising a plurality of choking ring segments, each of the choking ring segments corresponding to one of the choking ring pieces, the multi-piece choking ring being selectively positionable at a plurality of different axial positions relative to the multi-piece choking plug and along a barrel of the screw device;

wherein the screw device includes a worm assembly rotatable in a barrel about an axis to move material in a downstream direction in the barrel while compacting the material, the worm assembly including a shaft, the choke further comprising a hub for mounting on the shaft for rotation with the shaft, each of the choking plug segments being releasably mounted on the hub and removable from the hub without removal of the hub from the shaft.

2. A choke as set forth in claim 1 wherein the barrel has a discharge portion supporting the choking ring so that each of the ring segments is removable in a generally radial outward direction without disassembly of the barrel or removal of the worm assembly, each of the choking plug segments being removable from its location on the hub in a generally radial outward direction without disassembly of the barrel or removal of the worm assembly.

3. A choke as set forth in claim 1 wherein each of the plug segments has an upstream facing tapered surface and each of the choking ring segments has a downstream facing tapered surface disposed in facing relation to an upstream facing tapered surface of the choking plug, the tapered surfaces defining a choke passage between them, the size of the choke passage being dependent on the axial position of the choking ring along the barrel relative to the choking plug.

4. A choke as set forth in claim 1 wherein each of the choking ring segments has a plurality of axially extending ridges for resisting rotation of material in contact with the choking ring.

5. A choke as set forth in claim 1 wherein each of the choking plug segments has a cake cutter portion adapted to serve as a lifting portion for assisting in lifting the respective choking plug segment.

6. A choke as set forth in claim 1 wherein the screw device is a screw press with a barrel having a discharge portion by which substantially all oil removal from material being processed is completed, the choke being located at the downstream end of the discharge portion, the screw device including a water injector supported on the barrel for injecting water into the material in the discharge portion of the barrel.

7. A choke as set forth in claim 1 wherein the choking plug is supported on a shaft that decreases in diameter at a discharge portion, and the screw device has a plurality of stirring lugs at the discharge portion.

8. A choke as set forth in claim 1 wherein the choking plug is supported on a hub having an upstream facing first shoulder surface, and each of the choking plug segments has a downstream facing second shoulder surface that is engageable with the first shoulder surface on the hub to transfer thrust on the respective choking plug segment to the hub.

9. A choke as set forth in claim 1 wherein each of the choking ring segments comprises a support member adapted for mounting on a barrel and a wear pad adapted for releasable mounting on the support member, the wear pad having a tapered surface of the respective choking ring segment.

10. A choke as set forth in claim 1 further comprising a variable speed drive for the screw assembly.

11. A screw press comprising:

a barrel;

a worm assembly rotatable in the barrel about an axis to move material in a downstream direction in the barrel while compacting the material, the worm assembly including a shaft and a plurality of worm elements mounted on the shaft for rotation with the shaft; and a choke comprising a choking plug and a choking ring;

the choking plug comprising a plurality of choking plug segments releasably mounted on the shaft;

the choking ring cooperating with the choking plug, the choking ring comprising a plurality of choking ring segments releasably mounted on the barrel adjacent to the choking plug, each of the ring segments being selectively positionable at a plurality of different axial positions along the barrel relative to the choking plug.

12. A screw press as set forth in claim 11 wherein the barrel has a discharge portion supporting the choking ring so that each of the ring segments is removable from its location adjacent the choking plug in a generally radial outward direction without disassembly of the barrel or removal of the worm assembly, each of the choking plug segments being removable from its location on the hub in a generally radial outward direction without disassembly of the barrel or removal of the worm assembly; and wherein each of the plug segments has an upstream facing tapered surface and each of the choking ring segments has a downstream facing tapered surface disposed in facing relation to an upstream facing tapered surface of the choking plug, the tapered surfaces defining a choke passage between them, the size of the choke passage being dependent on the axial position of the choking ring along the barrel relative to the choking plug.

13. A screw press as set forth in claim 11 wherein the barrel has a discharge portion downstream of a drainage section, the choke being located at the downstream end of the discharge portion, the screw press including a water injector supported on the barrel for injecting water into the material in the discharge portion of the barrel, the barrel having a widened inside diameter at the discharge portion, and the worm assembly having at the discharge portion a plurality of stirring lugs.

14. A screw press as set forth in claim 11 further comprising a variable speed drive for the worm assembly.

15. A screw press as set forth in claim 11 wherein the choke further comprises a hub mounted on the shaft for rotation with the shaft, each of the choking plug segments being releasably mounted on the hub and removable from the hub without removal of the hub from the shaft.

16. A choke for a screw device, the choke comprising:

a multi-piece choking plug comprising a plurality of choking plug segments, each of the choking plug segments corresponding to one of the choking plug pieces; and a multi-piece choking ring cooperating with the choking plug, each of the choking ring segments corresponding to one of the choking ring pieces, the multi-piece choking ring being selectively positionable at a plurality of different axial positions relative to the multi-piece choking plug and along a barrel of the screw device;

wherein the screw device includes a worm assembly rotatable in the barrel about an axis to move material in a downstream direction in the barrel while compacting the material, the worm assembly including a shaft, the choke further comprising a hub for mounting on the shaft for rotation with the shaft, each of the choking plug segments being releasably mounted on the hub and removable from the hub without removal of the hub from the shaft; and wherein the barrel has a discharge portion supporting the choking ring so that each of the ring segments is removable in a generally radial outward direction without disassembly of the barrel or removal of the worm assembly, each of the choking plug segments being removable from its location on the hub in a generally radial outward direction without disassembly of the barrel or removal of the worm assembly.

17. A choke for a screw device, the choke comprising:

a multi-piece choking plug comprising a plurality of choking plug segments, each of the choking plug segments corresponding to one of the choking plug pieces; and a multi-piece choking ring cooperating with the choking plug, each of the choking ring segments corresponding to one of the choking ring pieces, the multi-piece choking ring being selectively positionable at a plurality of different axial positions relative to the multi-piece choking plug and along a barrel of the screw device;

wherein the screw device is a screw press with a screw rotating in the barrel having a discharge portion by which substantially all oil removal from material being processed is completed, the choke being located at the downstream end of the discharge portion, the screw device including a water injector supported on the barrel upstream of the choke for injecting water into the material in the discharge portion of the barrel at a location axially coextensive with the screw.

18. A choke for a screw device, the choke comprising:

a multi-piece choking plug comprising a plurality of choking plug segments, each of the choking plug segments corresponding to one of the choking plug pieces; and a choking ring cooperating with the choking plug, the choking ring being selectively positionable at a plurality of different axial positions relative to the multi-piece choking plug and along a barrel of the screw device;

wherein the choking plug segments are supported on a hub having an upstream facing first shoulder surface, and each of the choking plug segments has a downstream facing second shoulder surface that is engageable with the first shoulder surface on the hub to transfer thrust on the respective choking plug segment to the hub.

19. A screw press comprising:

a barrel;

a worm assembly rotatable in the barrel about an axis to move material in a downstream direction in the barrel while compacting the material, the worm assembly including a shaft and a plurality of worm elements mounted on the shaft for rotation with the shaft; and a choke comprising a multi-piece choking plug and a choking ring;

the choking plug comprising a plurality of choking plug segments releasably mounted on the shaft, each of the choking plug segments corresponding to one of the choking plug pieces;

the choking ring cooperating with the choking plug segments, the choking ring being selectively positionable at a plurality of different axial positions relative to the multi-piece choking plug and along the barrel and being releasably mounted on the barrel adjacent to the choking plug segments;

the force of the rotating worm assembly causing a forward thrust on the material being worked and a rearward thrust on the worm assembly;

the rearward thrust on the worm assembly being absorbed by a shoulder on the shaft of the worm assembly; and the force of the worm causing the material being worked to exert a forward thrust on the choking plug and thereby on the opposite end of the shaft of the worm assembly.

20. A choke as set forth in claim 8 wherein the hub is fixed axially relative to the shaft and forms a rigid base for mounting the choking plug.

* * * * *